US005339063A

United States Patent [19]

Pham

[11] Patent Number: 5,339,063

[45] Date of Patent: Aug. 16, 1994

[54] SOLENOID STATOR ASSEMBLY FOR ELECTRONICALLY ACTUATED FUEL INJECTOR

[75] Inventor: Anh Pham, Lakewood, Calif.

[73] Assignee: SKF U.S.A., Inc., Compton, Calif.

[21] Appl. No.: 134,689

[22] Filed: Oct. 12, 1993

[51] Int. Cl.[5] ..... F02M 47/02; B05B 1/30; H01F 7/08

[52] U.S. Cl. ..... 335/260; 239/88; 239/585.1; 335/278; 335/281

[58] Field of Search ..... 335/260, 278, 281; 336/96; 239/88, 585.1-585.5

[56] References Cited

U.S. PATENT DOCUMENTS 4,219,154 8/1980 Luscomb ..... 239/91
4,408,718 10/1983 Wich ..... 239/88
4,568,021 2/1986 Deckard et al. ..... 239/88
5,155,461 10/1992 Teerman et al. ..... 335/260

*Primary Examiner*—Leo P. Picard
*Assistant Examiner*—Raymond Barrera
*Attorney, Agent, or Firm*—Pretty, Schroeder, Brueggemann & Clark

[57] ABSTRACT

The present solenoid stator assembly mounts on a seat forming part of a fuel injector, secured to it by mounting bolts. A rigid metal outer housing has a base shaped to fit upon the mounting seat of the fuel injector and defines an interior chamber. An E-shaped stator core is located centrally within the interior chamber and an insulated plastic inner housing extends between the stator core and the outer housing to fixedly secure the core within the interior chamber. The outer housing reinforces the insulated plastic inner housing against the bulging forces imposed by high fuel pressure and protects it against damage from external blows.

7 Claims, 2 Drawing Sheets

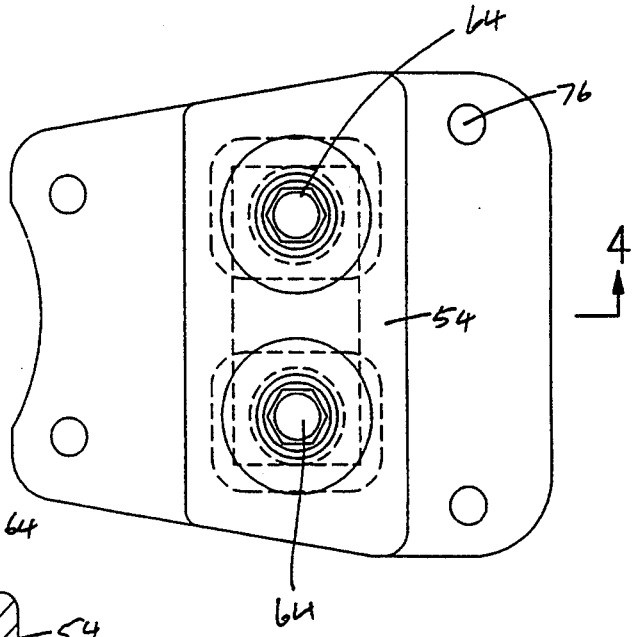
FIG. 3
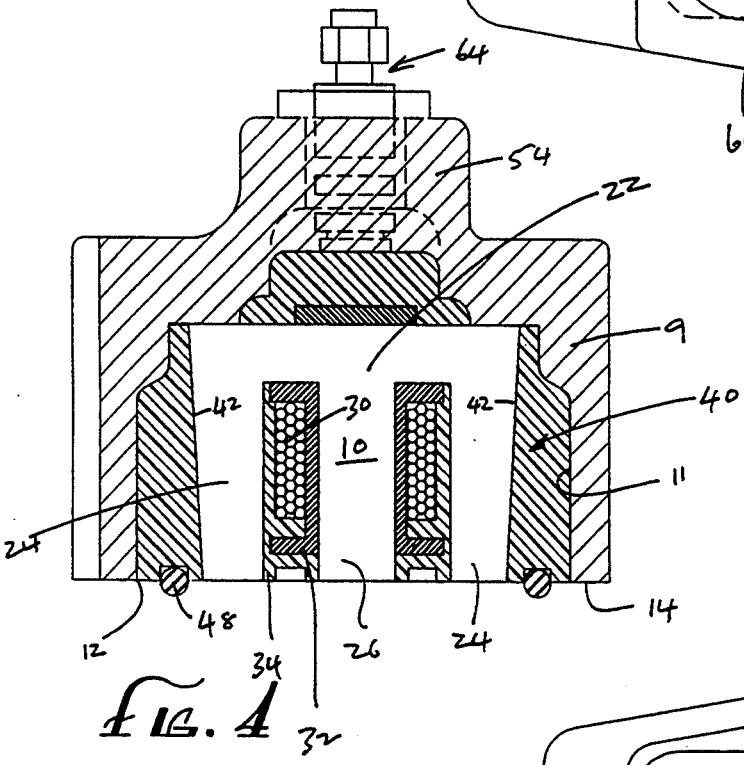
FIG. 4
FIG. 5
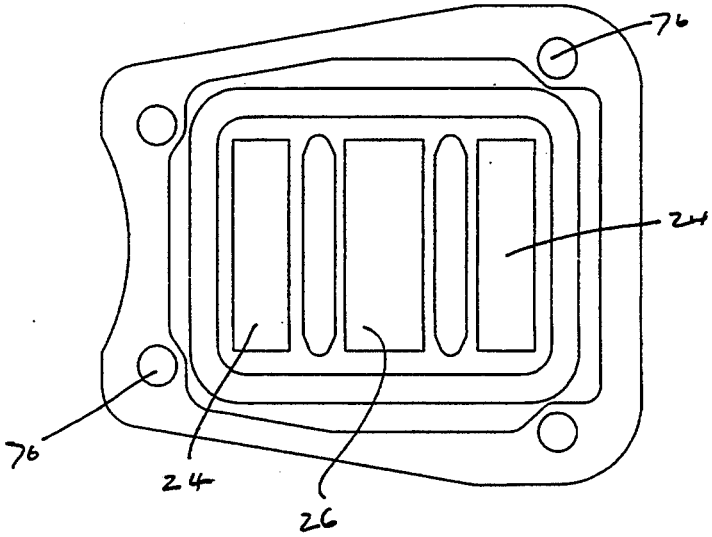

SOLENOID STATOR ASSEMBLY FOR ELECTRONICALLY ACTUATED FUEL INJECTOR

FIELD OF THE INVENTION

This invention relates to a solenoid stator assembly for an electronically actuated fuel injector.

BACKGROUND OF THE INVENTION

Most engines of trucks commonly used in the trucking industry now utilize fuel injectors to deliver an atomized fuel charge to the engine cylinders. Art electronic timing circuit delivers precisely timed electrical pulses for operation of the fuel injector. Such pulses are used in a solenoid stator assembly to reciprocate a solenoid plunger mounted in the fuel injector which controls the injection of fuel into the associated engine cylinder.

The solenoid stator assembly commonly requires a housing to protect its electrical components and to locate them precisely in relation to the reciprocating solenoid plunger. Commonly, such housings have involved insulative plastic housing components surrounding a stator core. The stator core extends through a stator coil which is pulsed with the electrical current to generate the magnetic forces necessary to reciprocate the plunger. In the design of such stator assemblies, it is necessary to overcome severe difficulties created by the very harsh working environment in which the assembly must function.

The stator assembly must be able to accommodate wide variations in operating temperature, from cold start up at below zero temperatures to under the hood temperatures in hot desert conditions exceeding 200° F., causing significant thermal expansion and contraction of the housing components. Leaking fuel droplets under high pressure from the injector can create high pressure within the interior of the plastic housing leading to cracking of the plastic. Over time and under these conditions of inter vibration and fluctuating temperature, plastic components of a housing can develop cracks and hairline fractures. Moreover, the plastic housing components can eventually become embrittled. Also, plastic components are at risk of impact damage if persons servicing the engine accidentally impact them with wrenches or other tools during the course of working on adjacent structures. Fuel injectors under current conditions of operation operate a fuel injection pressures of the order of 2000 pounds per square inch pressure. Escape of fuel under such high working pressures from leaking mechanical portions of the fuel injector can direct extremely high pressure of fuel against the plastic stator housing. The entry of such fuel into a crack in the plastic tends to expand and increase the crack and can cause eventual failure of the housing.

Various types of solenoid stator assembly have been developed to address these problems. One such stator assembly is shown in U.S. Pat. No. 5,155,461 to Teerman et al. for "Solenoid Stator Assembly for Electronically Actuated Fuel Injectors and Method of Manufacturing Same," owned by Diesel Technology Corporation. The Teerman patent discloses an actuator assembly for use with a fuel injector of the same type that the present invention is intended to function with. It has an E-shaped stator core having outer and central pole pieces received within a plastic housing that is bolted to a mounting base on the fuel injector. To prevent passage of leakage fuel under high pressure between the stator core and the housing, the Teerman device incorporates T-shaped notches in the outer faces of the stator pole pieces, into which the plastic material of the housing is molded, to present a barrier against the passage of fuel. The Teerman device is constructed by a process which involves prestressing the outer pole pieces of the core outwardly before the housing is molded about it. The prestressing provides restorative forces to oppose additional, fuel pressure related, forces that might be applied to the outer pole pieces and inhibit additional displacement.

While the T-shaped slots in the outer pole pieces of the Teerman device may be effective to resist fuel migration, it may require an additional machining step to provide such T-shaped slots thereby contributing to the manufacturing cost of the stator core. Additionally, the need to prestress the outer pole pieces before molding the housing around the stator core requires additional process steps during the manufacturing process. Finally, the use of a plastic housing which is directly vulnerable to accidental impacts from mechanical objects and to direct impingement by high pressure of fuel leaves the housing susceptible to the types of problem generally noted above.

SUMMARY OF THE INVENTION

A solenoid stator assembly, constructed according to the preferred embodiment of the present invention, is intended to overcome problems of the character described above.

The solenoid stator assembly of the present invention is mountable upon a mounting seat forming part of the fuel injector and is securable to it by mounting bolts engaging the fuel injector. The assembly includes a rigid metal outer housing having a base shaped to It upon the mounting seat of the fuel injector. Interior surfaces of the outer housing define an interior chamber extending vertically within it from an opening through the housing base. An E-shaped stator core, having two outer pole pieces and a central pole piece, is located centrally within the interior chamber. The pole pieces have their free ends within the opening in the outer housing base generally Bush with it. An insulated, plastic inner housing extends between the stator core and the interior surfaces of the outer housing to fixedly secure the core within the interior chamber. The inner housing rests upon portions of the mounting seat of the fuel injector and is firmly clamped against them by securement of the outer housing to the mounting seat by the mounting bolts. The outer pole pieces of the core have outer surfaces facing towards the adjacent interior surfaces of the housing. The pole piece outer surfaces are inclined downwardly and longitudinally inwardly of the core to impart a generally keystone-like silhouette to the core.

Significant advantages result from this construction. The metal outer housing provides a solid reinforcement around the inner plastic housing and strengthens it against cracking under high pressures that within the plastic housing can sometimes build up within it. Even if cracks develop in the inner plastic housing, the keystone shape of the core insures that the core cannot move out of position. Because the outer housing and mounting seat clamp around the inner plastic housing, the development of cracks within the inner housing does not permit the plastic to release the retaining forces which it exerts on the stator core through the sloped outer surfaces of the pole pieces, thus maintaining the stator core precisely located within the stator assembly.

The metal housing also provides enhanced protection against accidental mechanical impact, from tools during servicing. It also provides added protection against cracks caused by uneven loading of the inner housing during torquing down the mounting bolts.

These and other advantages of the present invention are described more fully in the subsequent detailed description.

BRIEF DESCRIPTION OF THE DRAWINGS

A solenoid stator assembly constructed in accordance with the preferred embodiment of the invention is illustrated in the accompanying drawings in which:

FIG. 3 is a plan view, from the top, of the stator assembly shown in FIGS. 1 and 2;

FIG. 4 is a cross-sectional side view of the stator assembly shown in FIG. 3 taken along the lines 4—4 therein;

FIG. 5 is a plan view, from the underside, of the stator assembly shown in FIGS. 1 and 2.

DETAILED DESCRIPTION

Figure 1:
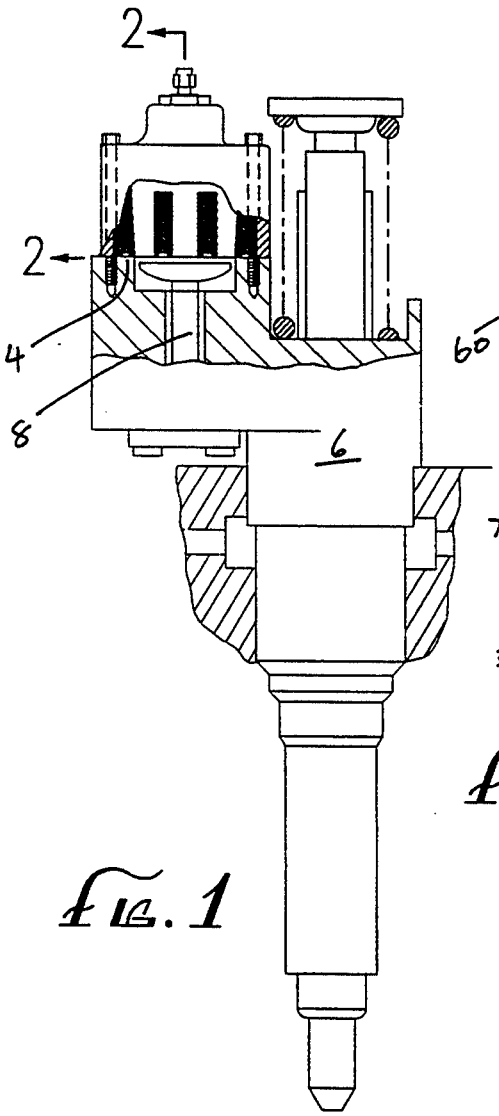
FIG. 1 is a fragmented view of a solenoid stator assembly according to the preferred embodiment of the invention mounted upon an electronically actuated fuel injector.

A solenoid stator assembly according to the present invention, generally designated 2, is shown mounted upon a mounting seat 4 of a fuel injector 6 (FIG. 1). The fuel injector 6 includes a solenoid plunger 8 mounted for reciprocation in the fuel injector, in response to electrical pulses from a controller applied to the stator assembly, to control the operation of the fuel injector. The details of the controller or the fuel injector do not form a part of the invention. The fuel injector may be of the type described in U.S. Pat. No. 4,568,021, the relevant disclosure of which is incorporated herein by reference.

Figure 2:
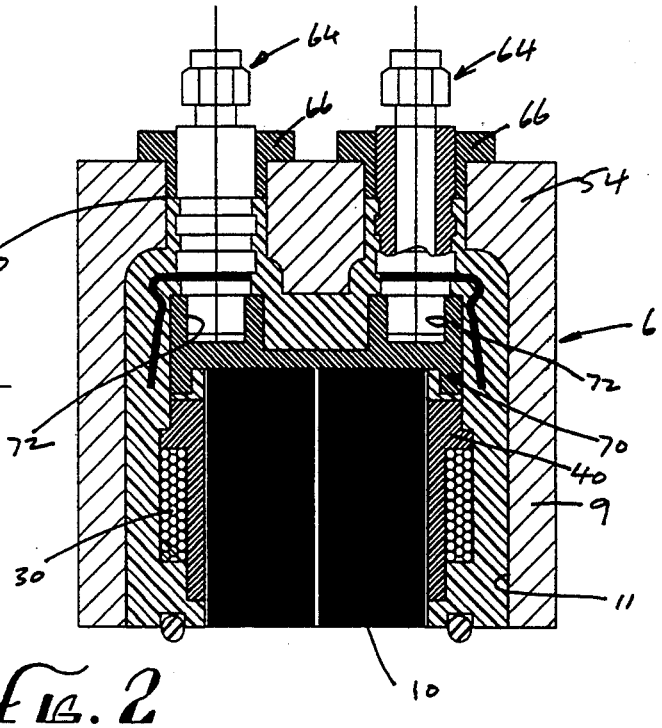
FIG. 2 is a cross-sectional end view of the stator assembly shown in FIG. 1 taken along the lines 2—2 therein.

The solenoid stator assembly (FIG. 3) fuel injector includes a generally rectangular, rigid outer housing 9 which houses a stator core 10 (FIG. 4). The outer housing 9 is made of die cast metal and is thick enough to be substantially rigid. The metal may typically be aluminum. Interior surfaces within the outer housing 9 define a generally rectangular vertical cavity 11 extending longitudinally (FIG. 4) and laterally (FIG. 2). The interior chamber 11 includes an opening 12 extending through a generally flat, base surface 14 of the outer housing.

The stator core 10 generates the magnetic fields required to reciprocate the solenoid plunger 8 of the fuel injector. The stator core is E-shaped having a core base 22 which extends horizontally and longitudinally within the interior chamber 11 parallel to the housing base 14. Two outer pole pieces 24 depend at right angles from the longitudinally outer ends of the base 22 of the core with a center pole piece 26 positioned midway between them. The pole pieces have their lower ends flush with the base 14 of the outer housing. The stator core is fabricated from a plurality of identical laminations of magnetizable material (FIG. 2). The magnetic fields necessary to reciprocate the plunger are generated by a wire coil 30 wound upon a spool 32 extending around the center pole piece 26. Insulating material 34 encases the coil and the spool in the gaps between the pole pieces.

The stator core is held in place by an insulative plastic inner housing 40 (FIGS. 2 and 4). The inner plastic housing 40 has its lower surface resting upon the surface 4 of the mounting seat of the fuel injector and is clamped securely against it by the outer housing 9. The inner housing is molded in position by a process which commences with mounting the stator core in its desired centralized location within the inner chamber 11 by a temporary fixture (not shown). The plastic material, in liquid state, is then filled into the space between the exterior surfaces of the stator core and the interior surfaces defining the chamber 11 and caused to harden in situ. The plastic material must be one that is capable of being cured or heat set to change it from a liquid to a solid condition, must be diesel fuel resistant, has good electrical insulation properties and withstand temperatures to 300° F. It should be resistant to the development of cracks and hairline fractures when subjected to an environment of vibration and repeated severe fluctuations of temperature. In the preferred embodiment, the material used is a thermoplastic polyester resin sold by Du Pont having the designation RYNITE-530.

A significant aspect of this invention resides in the cooperation between the shape of the outer surfaces of the outer pole pieces and the inner housing. Each outer pole piece (FIG. 4) has an outer surface 42 which is sloped downwardly and longitudinally inwardly, from the top of the core base 22 to the bottom of the pole piece. These outer surfaces 42, in conjunction with the parallel horizontal upper and lower surfaces, give the stator core a keystone-like silhouette. The metal outer housing 9 rigidly reinforces the inner housing 40 so that even if, under the effects of high internal pressure, prolonged vibration and thermal stress, cracks develop in the inner housing 40, the wedging action of the sloped cooperating surfaces 42 with the inner housing securely maintains the fixed position of the stator core within the stator assembly.

The positioning of the stator core is further enhanced by resilient biasing provided by an O-ring 48. The O-ring is mounted in an O-ring groove 50 extending peripherally around the lower base surface of the inner housing 40, created during the molding process. The O-ring 48 is squeezed against the surface 4 of the mounting seat of the fuel injector and biases the inner housing 40 continuously against the sloped outer surfaces 42 of the outer pole pieces. Thus, even the development of cracks in the inner housing 40 does not relieve the secure holding force which the inner housing continuously exerts upon the stator core to maintain its desired location within the outer housing 2. Another advantage provided by the inclination of the outer surfaces 42 of the stator core is that the direction of inclination, plus the resilient biasing of O-ring 48, works to inhibit any passage of migrant fuel under pressure along the boundary between those outer surfaces and the inner housing 40 to minimize the development of cracks in the inner housing, caused by fuel under very high pressure, penetrating and expanding hairline fractures or cracks. Additionally, the O-ring 48 assists in sealing against the ingress of migrant fuel along the interface between the solenoid actuating assembly 2 and the mounting seat 4 of the fuel injector. Alternatively, the O-ring groove may be provided in the mounting seat instead of the base of the inner housing which would be flat to seal against the O-ring.

It is necessary to provide electrical terminals by which the activating electrical current is delivered to the wire coil 30. For this purpose, the outer housing 9 is provided on its upper horizontal surface with a generally rectangular projection 54 (FIG. 3) extending laterally across the center of the outer housing. The projection 54 has two laterally spaced vertical openings 60 which receive spaced, vertically extending electrical terminal units 64 (FIG. 2). Each terminal unit is supported by an insulator collar 66 which extends into the opening 60 surrounds the terminal to insulate it from electrical contact with the outer housing 9. The terminals 64 are connected by a conventional electrical wiring to the opposite ends of the coil of wire. Support for the lower ends of the terminals is provided by a terminal locator unit 70. The terminal locator 70 is made of insulative plastic and is shaped to extend across the full lateral width of the stator core 10 resting on a central region of the core base 22. The terminal locator has two raised projections with wells 72 extending downwardly within them to receive and provide support for the ends of the electrical terminal 64. The terminal locator and terminals are placed in position before the performance of the previously described step of molding the inner housing 40. Thus, in the step of molding the inner housing 40, portions of the plastic surround and encase the terminal locator and adjacent portions of the electrical terminal 64 to assist in holding them in position relative to the outer housing and to insulate them from it.

Figure 6:
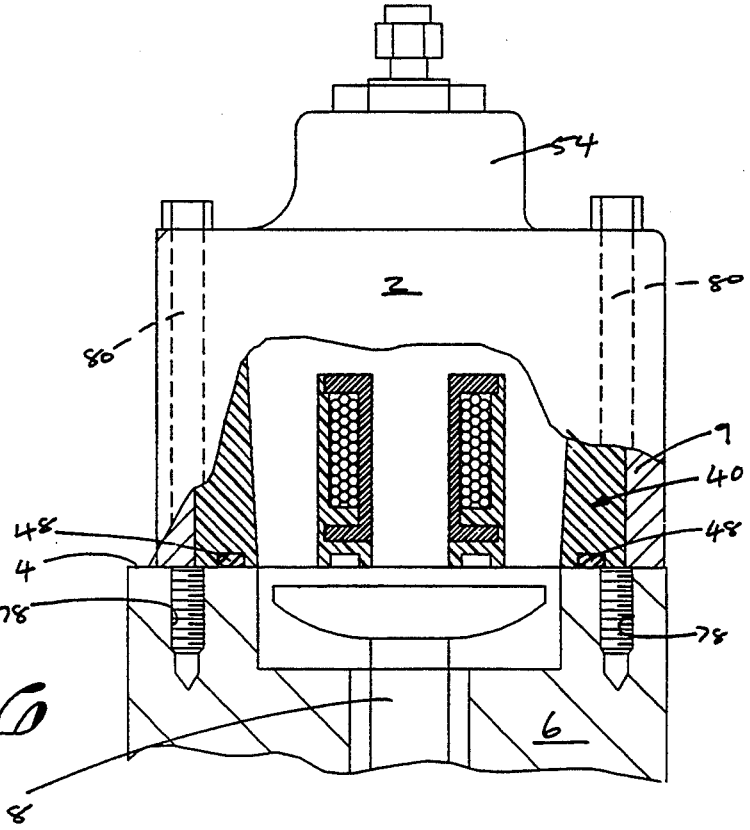
FIG. 6 is an enlarged view showing the mounting of the stator assembly upon the mounting base of the fuel injector.

The attachment of the stator assembly to the fuel injector is shown in more detail in FIG. 6. The outer housing 9 is provided with four mounting holes 76, adjacent its corners, which extend downwardly through the housing outside the interior chamber 11. The positions of the mounting holes 76 are chosen to align with the placement of corresponding threaded mounting holes 78 in the body of the fuel injector extending downwardly from its mounting seat 4. Bolts 80, headed at their upper ends and threaded at their lower ends, extend through the mounting holes 76 and are threadedly engaged with the openings 78 to exert the desired clamping force on the outer housing to secure it flush against the mounting seat 4 of the fuel injector and to resiliently squeeze the O-ring 48.

The solenoid stator assembly of the present invention offers significant advantages. The use of a rigid metal outer housing to reinforce the inner housing against cracking coupled with the sloped outer surfaces on the stator core to retain it securely clamped in position within the outer housing, ensures that the correct positioning of the stator core is maintained even if cracks or hairline fractures eventually develop in the plastic inner housing. The biasing effect achieved by the squeezed O-ring also assists in maintaining the holding action provided by the inwardly and downwardly sloped outer surfaces of the stator core. The downward and inward slope of the outer surfaces of the pole pieces also inhibits the unwanted passage of fuel under pressure along the interface between the outer surfaces of the pole pieces and the inner plastic housing. The outer housing also contributes significantly to improved product life by protecting the plastic inner housing against injurious accidental mechanical blows.

Although the invention has been described with reference to one preferred embodiment, it will be appreciated by those skilled in the art that many obvious variations and modifications may be made to the structures described herein without departing from the invention defined in the appended claims.

I claim:

1. A solenoid stator assembly for an electronically activated fuel injector, mountable upon a generally flat mounting seat forming part of the fuel injector and securable thereto by mounting bolts engaging the fuel injector, the stator assembly comprising, a rigid, metal outer housing having, a generally flat housing base shaped to fit upon the mounting seat of the fuel injector;

interior surfaces defining a generally rectangular interior chamber extending vertically within said housing from an opening through said housing base;

mounting portions receiving the mounting bolts to secure said housing to the fuel injector with said housing base mounted on the mounting seat of the fuel injector;

an E-shaped stator core located generally centrally within said interior chamber having, a core base extending in a longitudinal direction parallel to and spaced vertically above said outer housing base, said core base positioned above said opening in said outer housing base;

two outer pole pieces depending generally perpendicularly from opposite longitudinal ends of said core base;

a center pole piece depending generally perpendicularly from said core base positioned centrally between said outer pole pieces; said outer and central pole pieces having free ends disposed within said opening in said outer housing base generally flush therewith;

an insulative, plastic, inner housing extending between said stator core and said interior surfaces of said outer housing to fixedly secure said core within said interior chamber, said inner housing resting upon portions of the mounting seat of the fuel injector and being firmly clamped thereagainst by securement of said outer housing to the mounting seat by the mounting bolts; said inner housing being reinforced by said outer housing against bulging pressure developed within the assembly by fuel escaping from the injector.

2. A solenoid stator assembly as defined in claim 1 wherein said outer pole pieces further have, outer surfaces facing towards the adjacent interior surfaces of said outer housing, said pole piece outer surfaces being inclined downwardly and longitudinally inwardly of said core thereby assisting securement of said stator core in its location within said interior chamber and inhibiting travel of fuel between said pole piece outer surfaces and said inner housing.

3. A solenoid stator assembly as defined in claim 2 further including, an O-ring groove in one of said base of said inner housing and the mounting seat, and a resiliently compressible O-ring mounted in said O-ring groove clamped between said base of said inner housing and the mounting seat to resiliently bias said inner housing against said outer surfaces of said outer pole pieces to maintain the positioning of said stator core even if cracks develop in said plastic inner housing.

4. A solenoid stator assembly as defined in claim 1 wherein said inner housing is formed by the steps of, using a removable fixture to mount said stator core in position generally centrally within said interior chamber of said outer housing spaced from the interior surfaces thereof;

filling the space between said core and the interior surfaces of said outer housing with the plastic in a liquid condition of said plastic;

causing the plastic to harden to a rigid condition; and removing the fixture.

5. A solenoid stator assembly as defined in claim 1 further including, an insulative spool extending around said center pole piece of said stator core;

a wire coil wound upon said spool and having opposite ends; and terminals mounted within and insulated from said outer housing extending into said inner housing, said first and second terminals being connected to opposite ends of said wire coil.

6. A solenoid stator assembly as defined in claim 1 further including, an insulative terminal locator having, a body member resting on an upper surface of said core base extending laterally thereacross;

two well portions in said body member for receiving and retaining lower ends of said first and second terminals.

7. A solenoid stator assembly for an electronically activated fuel injector, mountable upon a generally fiat mounting seat forming part of the fuel injector and securable thereto by mounting bolts engaging the fuel injector, the stator assembly comprising, a rigid, metal outer housing having, a generally fiat housing base shaped to fit upon the mounting seat of the fuel injector;

interior surfaces defining a generally rectangular interior chamber extending vertically within said housing from an opening through said housing base;

mounting portions receiving the mounting bolts to secure said housing to the fuel injector with said housing base mounted on the mounting seat of the fuel injector;

an E-shaped stator core located generally centrally within said interior chamber having, a core base extending in a longitudinal direction parallel to and spaced vertically above said outer housing base, said core base positioned above said opening in said outer housing base;

two outer pole pieces depending generally perpendicularly from opposite longitudinal ends of said core base;

a center pole piece depending generally perpendicularly from said core base positioned centrally between said outer pole pieces; said outer and central pole pieces having free ends disposed within said opening in said outer housing base generally flush therewith;

an insulative, plastic, inner housing extending between said stator core and said interior surfaces of said outer housing to fixedly secure said core within said interior chamber, said inner housing resting upon portions of the mounting seat of the fuel injector and being firmly clamped thereagainst by securement of said outer housing to the mounting seat by the mounting bolts;

said outer pole pieces further having, outer surfaces facing towards the adjacent interior surfaces of said outer housing, said pole piece outer surfaces being inclined downwardly and longitudinally inwardly of said core;

a downwardly facing O-ring groove within one of said base of said inner housing and the mounting seat extending peripherally around said opening in said base of said outer housing, and a resilient O-ring mounted in said O-ring groove, said O-ring being squeezed between said inner housing and the mounting seat of the fuel injector, during securement of said outer housing by the mounting bolts, to seal against ingress of fuel and to resiliently bias said inner housing against said inclined outer surfaces of said outer pole pieces, thereby assisting securement of said stator core in its location within said interior chamber and inhibiting travel of fuel between said pole piece outer surfaces and said inner housing.

* * * * *